US006378348B1

(12) United States Patent
Katsube

(10) Patent No.: US 6,378,348 B1
(45) Date of Patent: Apr. 30, 2002

(54) HEMMING PROCESS AND HEMMING APPARATUS

(75) Inventor: Hiroshi Katsube, Hiroshima (JP)

(73) Assignee: Hirotec Corporation, Hiroshima (JP)

( * ) Notice: Subject to any disclaimer, the term of this patent is extended or adjusted under 35 U.S.C. 154(b) by 0 days.

(21) Appl. No.: 09/633,337

(22) Filed: Aug. 4, 2000

(30) Foreign Application Priority Data

Aug. 4, 1999 (JP) ..... 11-220674

(51) Int. Cl.[7] ..... B21D 39/02
(52) U.S. Cl. ..... 72/312; 72/420; 29/243.58
(58) Field of Search ..... 72/312, 313, 315, 72/387, 420, 421, 322, 323; 29/243.58, 243.57, 243.5, 509

(56) References Cited

U.S. PATENT DOCUMENTS

| | | | | | |
|---|---|---|---|---|---|
| 3,092,057 | A | * | 6/1963 | Warshilek | 72/312 |
| 4,706,491 | A | * | 11/1987 | Sartorio | 72/461 |
| 4,901,555 | A | * | 2/1990 | Shimoichi | 72/322 |
| 5,150,508 | A | * | 9/1992 | St. Denis | 29/243.5 |
| 5,454,261 | A | * | 10/1995 | Campian | 72/323 |
| 6,029,334 | A | * | 2/2000 | Hartley | 29/509 |
| 6,182,492 | B1 | * | 2/2001 | Raffin | 72/323 |

FOREIGN PATENT DOCUMENTS

| | | | | |
|---|---|---|---|---|
| JP | 57-118823 | * | 7/1982 | 72/420 |
| JP | 10-249454 | * | 9/1998 | 72/306 |
| JP | 2-15830 | * | 2/1999 | 72/315 |

* cited by examiner

*Primary Examiner*—Daniel C. Crane
(74) *Attorney, Agent, or Firm*—Sughrue Mion, PLLC

(57) ABSTRACT

A hemming apparatus for vertically moving an upper mold toward a lower mold to thereby compress the marriage panel whereby the marriage panel is hemmed is disclosed. The apparatus further comprises a mechanism for moving the lower mold in the horizontal direction to allow the lower mold to be movable from the position to be hemmed facing to the upper mold and a position for setting the panel where the marriage panel is set. Also disclosed in a hemming process comprising setting one panel on another panel to form a marriage panel, and unifying these panels with each other by claming the marriage panel between an upper mold and a lower mold. The process involves the following steps: a first step for setting the marriage panel onto the lower mold by a transporting unit; a second step for moving the lower mold on which the marriage panel has been set to the position to be hemmed, facing to upper mold by means of a mechanism for moving the lower mold; and a third step for vertically moving the upper mold to the position corresponding to the lower mold moved to the position to be hemmed to thereby compress the marriage panel.

12 Claims, 8 Drawing Sheets

HEMMING PROCESS AND HEMMING APPARATUS

BACKGROUND OF THE ART

1. Field of the Invention

The present invention relates to a hemming process and a hemming apparatus, which hems a panel on a lower mold while actuating an upper mold in a vertical direction.

2. Description of the Prior Art

A door panel for a vehicle or a similar panel is formed by putting an inner panel together with an outer panel (the state of these panels being together with each other is referred to as a "marriage panel"), and hemming the marriage panel as a rule. The hemming process is a process in which an edge portion of one panel is rolled up, to be unified with the other panel which is in a clamped state.

With reference to the attached drawings, the conventional hemming apparatus used in such a hemming processing and the conventional hemming process utilizing the same will now be described.

FIG. 8 is an explanatory view showing the conventional hemming apparatus, where FIG. 8A is a perspective view of one example of the conventional hemming apparatus (hereinafter referred to as the "first conventional apparatus"), and FIG. 8B is a perspective view of another example of the conventional hemming apparatus (hereinafter referred to as the "second conventional apparatus").

The first conventional apparatus 100 and the second conventional apparatus 200 have upper molds 101, and 201, lower molds 102 and 202, respectively. In each case, the lower mold 102 or 202 is fixed at the position to be hemmed, and the upper mold 101 or 201, which is actuated vertically, is placed upside the lower mold 102 or 202.

In the first conventional apparatus 100, a part of the lower mold 102 is cut out and an insert hole 103 is formed at this position, into which a means 104 for material handling with a marriage panel W is inserted.

An outer panel W1 and an inner panel W2 are unified with each other to form the marriage panel W, and the marriage panel thus formed is set onto the means 104 of material handling. The means 104 of material handling, onto which the marriage panel W is set, is transported by a robot arm 105 to be inserted into the insert hole 103. Upon inserting the means 104 of material handling at a prescribed position, the upper mold 101 descends to thereby apply the marriage panel W to hemming processing.

In the case of the second conventional apparatus 200, no insert hole is formed in the lower mold 202. Instead of the insert hole 102, a stroke length ST of the vertical movement of the upper mold 202 takes long, and the marriage panel W is directly set onto the lower mold 202.

More specifically, first a sufficient distance is formed between the upper mold 201 and the lower mold 202 by the vertical movement of the upper mold 201. Thereafter, the robot arm 205 adsorbs and holds the marriage panel W, and the marriage panel W is set at a prescribed position of the lower mold 202 by means of the bending movement of the robot arm 205. After the marriage panel W has been set, the robot arm 205 leaves the marriage panel W, and then the upper mold 201 descends to press the marriage panel W to carry out hemming processing.

In the case of the first conventional apparatus 100, since the marriage panel is set by inserting the means of material handling into the insert hole 103, the hemming processing at the edge of the marriage panel W position near the insert hole 103 cannot be applied. Specifically, if the marriage panel W should be applied to the hemming processing over the entire circumferences of the marriage panel W, the first conventional apparatus 100 cannot be applied.

On the other hand, according to the second conventional apparatus, it is possible to apply the hemming processing over the entire circumferences of the marriage panel W. However, in the case of the second conventional apparatus, since it is necessary to take a large length of the vertical stroke ST of the upper mold 201, the apparatus 200 itself becomes large. In particular, since the upper mold 201 has a heavy weight, the apparatus must have a construction which can bear such a heavy weight. Moreover, if a sufficient stroke length ST of the vertical movement of the upper mold 202 is secured, the cost for producing the apparatus is increased, resulting in higher production costs.

Furthermore, a stroke length ST of the vertical movement of the upper mold 202 lead to a long processing cycle time, delaying the processing time and lowering the process efficiency.

SUMMARY OF THE INVENTION

An object of the present invention is to solve the problems associated with the prior art and to provide a hemming process and a hemming apparatus which can reduce the cycle time to enhance the workability.

According to the present invention, a hemming process comprises putting one panel together with another panel to form a marriage panel, and unifying these panels with each other by clamping the marriage panel between an upper mold and a lower mold; said process involving the following steps:

- a first step for setting said marriage panel onto the lower mold by a transporting unit;
- a second step for moving the lower mold on which said marriage panel has been set to the position to be hemmed, facing to upper mold by means of a mechanism for moving the lower mold; and
- a third step for vertically moving the upper mold to the position corresponding to the lower mold moved to the position to be hemmed to thereby compress the marriage panel.

In order to put this process into practical utilization, there is provided a hemming apparatus for vertically moving an upper mold toward a lower mold to thereby compress said marriage panel whereby the marriage panel is hemmed; said apparatus further comprising:

- a mechanism for moving the lower mold in the horizontal direction to allow the lower mold to be movable from the position to be hemmed facing to the upper mold and a position for setting the panel where said marriage panel is set.

According to the hemming process and the hemming apparatus according to the present invention, the hemming cycle time can be reduced.

According to the preferred embodiment of the hemming apparatus of the present invention, the hemming apparatus is equipped with a mechanism for floating the lower mold which supports the lower mold in a floating state.

In this preferred embodiment, since it is not necessary to lift the lower mold for every movement of the lower shift by means of a die lifter or such, the time required for moving the lower mold can be reduced.

BRIEF DESCRIPTION OF THE DRAWINGS

FIG. 8A is a perspective view of one example of the conventional hemming apparatus, and FIG. 8B is a perspective view of another example of the conventional hemming apparatus.

DESCRIPTION OF THE PREFERRED EMBODIMENTS

By referring to the attached drawings, embodiments of the hemming apparatus according to the present invention will now be described in detail.

Figure 1:
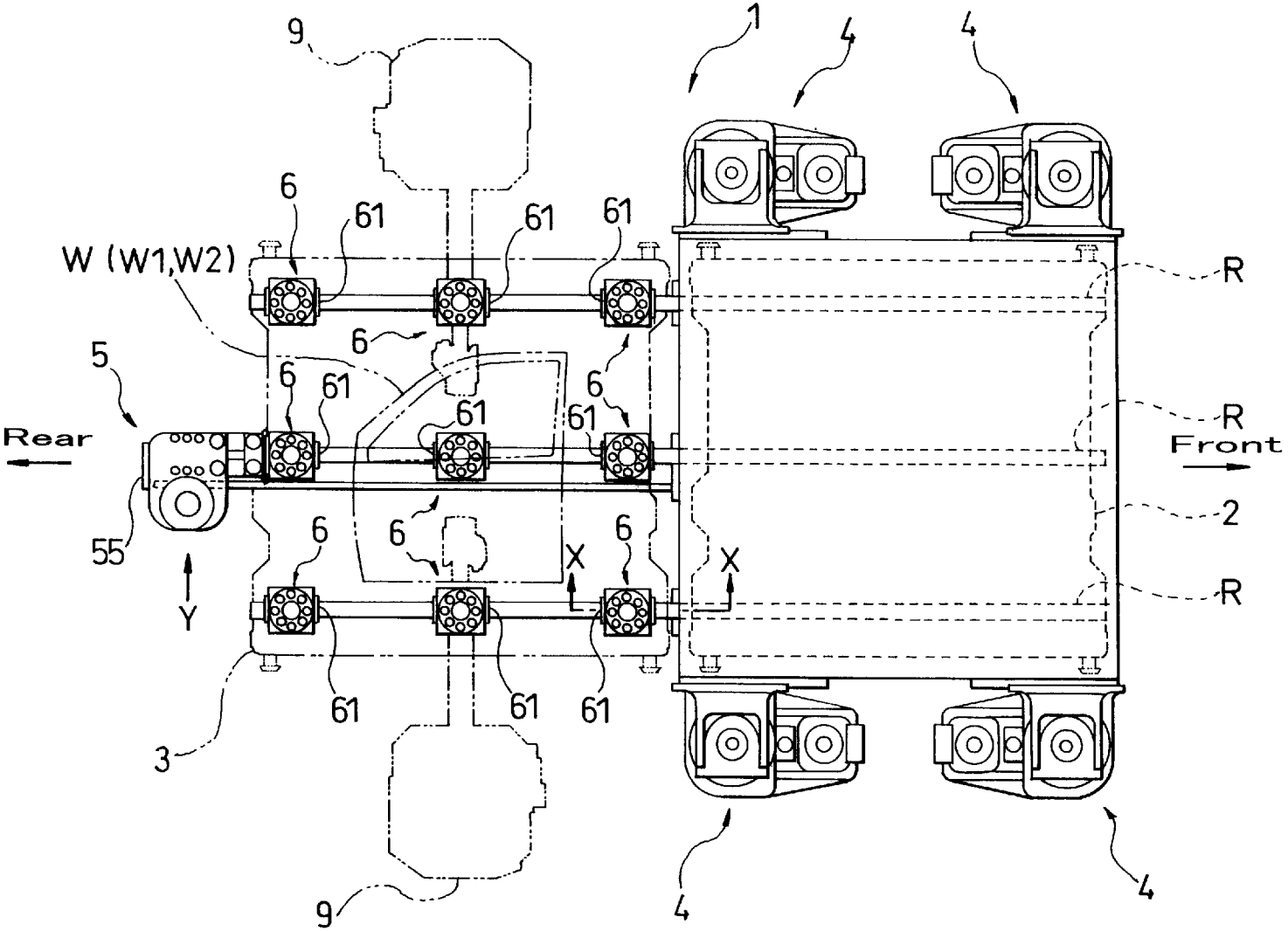
FIG. 1 is a perspective plane view of a hemming apparatus according to the present invention.
Figure 2:
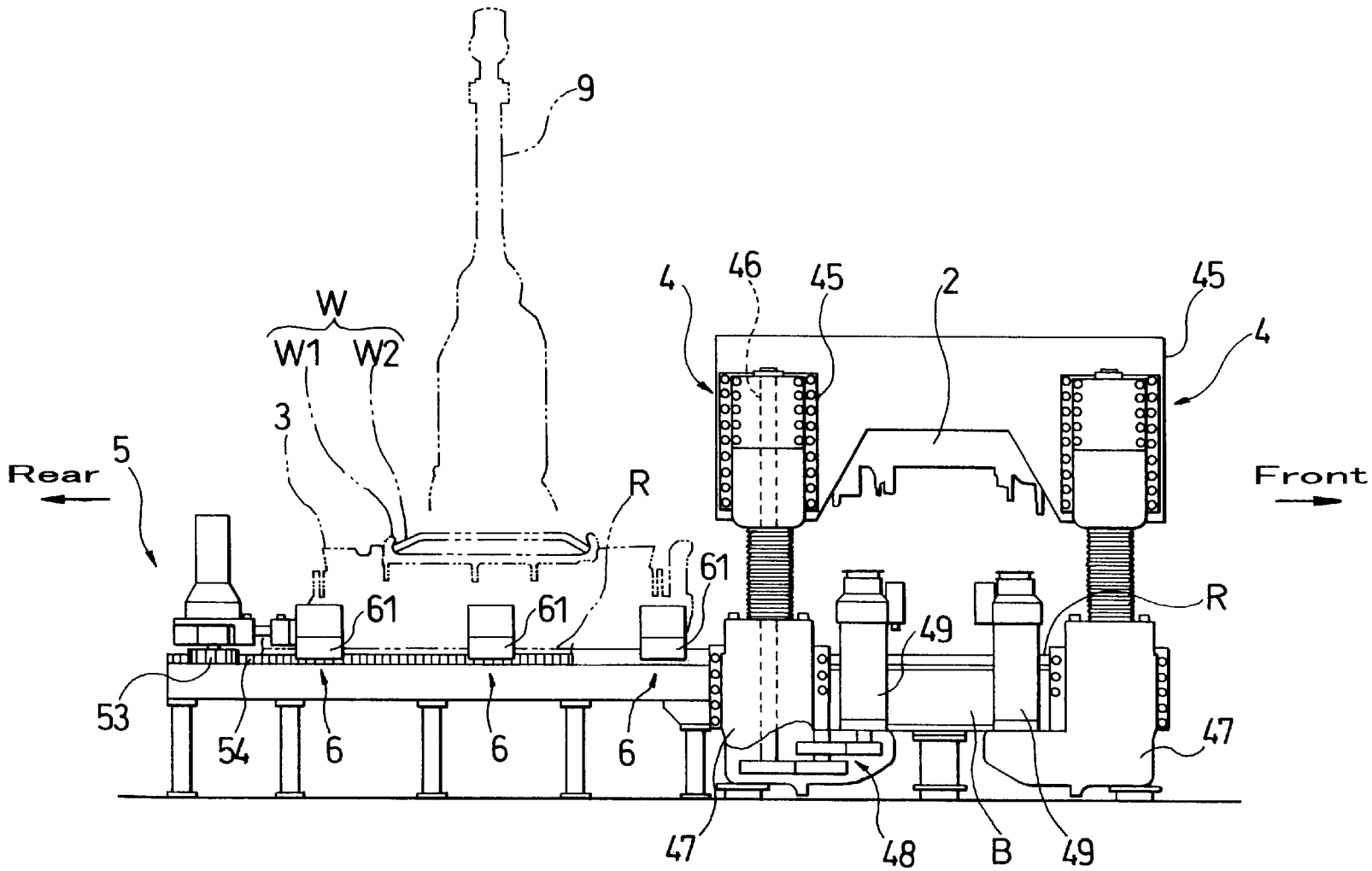
FIG. 2 is a perspective side view of a hemming apparatus according to the present invention.

FIG. 1 is a perspective plane view of a hemming apparatus according to the present invention, and FIG. 2 is a perspective side view of a hemming apparatus according to the present invention. In this embodiment, an outer panel W1 corresponds to one panel and an inner panel W2 corresponds to another panel. These panels W1 and W2 are put together with each other to form a marriage panel W. It should be noted that the present invention is not restricted to hemming a marriage panel composed of two panels W1 and W2, and is intended to widely include the hemming process, for example, of a marriage panel composed of a plurality of panels.

The hemming apparatus 1 of the present invention possesses an upper mold 2 equipped at the position to be hemmed, and a lower mold 3 which horizontally moves between the position to be hemmed and the position for setting the panel. Between the position for setting the panel and the position to be hemmed, three guide rails R, R, and R which are parallel to each other are lain, and the lower mold 3 moves along these guide rails R, R, and R.

The lower mold 3 moves in a controlled manner by means of a mechanism 5 for moving the lower mold. Floater units 6 which make up a mechanism for floating the lower mold are placed under the lower mold 3 to aid the movement of the lower mold 3.

The upper mold 2 is supported by a plurality of mechanisms 4 for pressing the upper mold in a vertically movable manner, and the vertical movement of the upper mold 2 is controlled by driving these mechanisms 4 for pressing the upper mold.

Right and left robots 9 and 9 for transporting the panel (hereinafter simply referred to as "robots") corresponding to transportation means face each other across the lower mold 2. These robots 9 and 9 transport and set the outer panel W1 and the inner panel W2 to a prescribed portion on the lower mold 3.

In this embodiment, the outer panel W1 and the inner panel W2 are transported by the robots 9 and 9, and are put together with each other on the lower mold 3 to form the marriage panel W. However, it should be noted that the present invention is not restricted to such an embodiment, and, for example, it is possible that one robot alternatively transports the outer panel W1 and the inner panel W2. It is also possible that the outer panel W1 and the inner panel W2 have previously been put together with each other to form the marriage panel W in advance, and the formed marriage panel W is transported onto the lower mold 3 by the robot 9. W2 have previously been put together with each other to form the marriage panel W in advance, and the formed marriage panel W is transported onto the lower mold 3 by the robot 9.

When the marriage panel W is set onto the lower mold 3, the lower mold 3 then moves horizontally. Due to the horizontal movement of the lower panel 3, the lower mold 3 reaches the position facing to the upper mold 2, i.e., the position to be hemmed.

When the lower mold 3 reaches the position to be hemmed, the upper press mechanism 4 is positively operated whereby the upper mold 2 descends to compress the marriage panel W. Due to the compression, the marriage panel is hemmed.

When the hemming process has been completed, the upper press mechanism 4 is negatively operated whereby the upper mold 2 ascends to release the compression to the marriage panel W. Meanwhile, the lower mold 3 horizontally moves at the position for setting the panel. When the lower mold 3 reaches the position for setting the panel, the robots 9 and 9 operate to transport the marriage panel W to the post stage.

The hemming apparatus 1 according to the present invention will now be described in greater detail.

The lower mold 3 according to this embodiment is supported by the floater units 6 which make up a mechanism for floating the lower mold, and moves horizontally by means of the mechanism for floating the lower mold. Nine floater units 6, 6, . . . are placed under lower mold 3 at the positions along the three guide rails R . . . , and the mechanism 5 for moving the lower mold is connected to the rear end of the lower mold 3 (see FIGS. 1 and 2). Rail communication portions 61, . . . 55 are placed under the floater units 6, . . . and the mechanism 5 for moving the lower mold, respectively.

Figure 3:
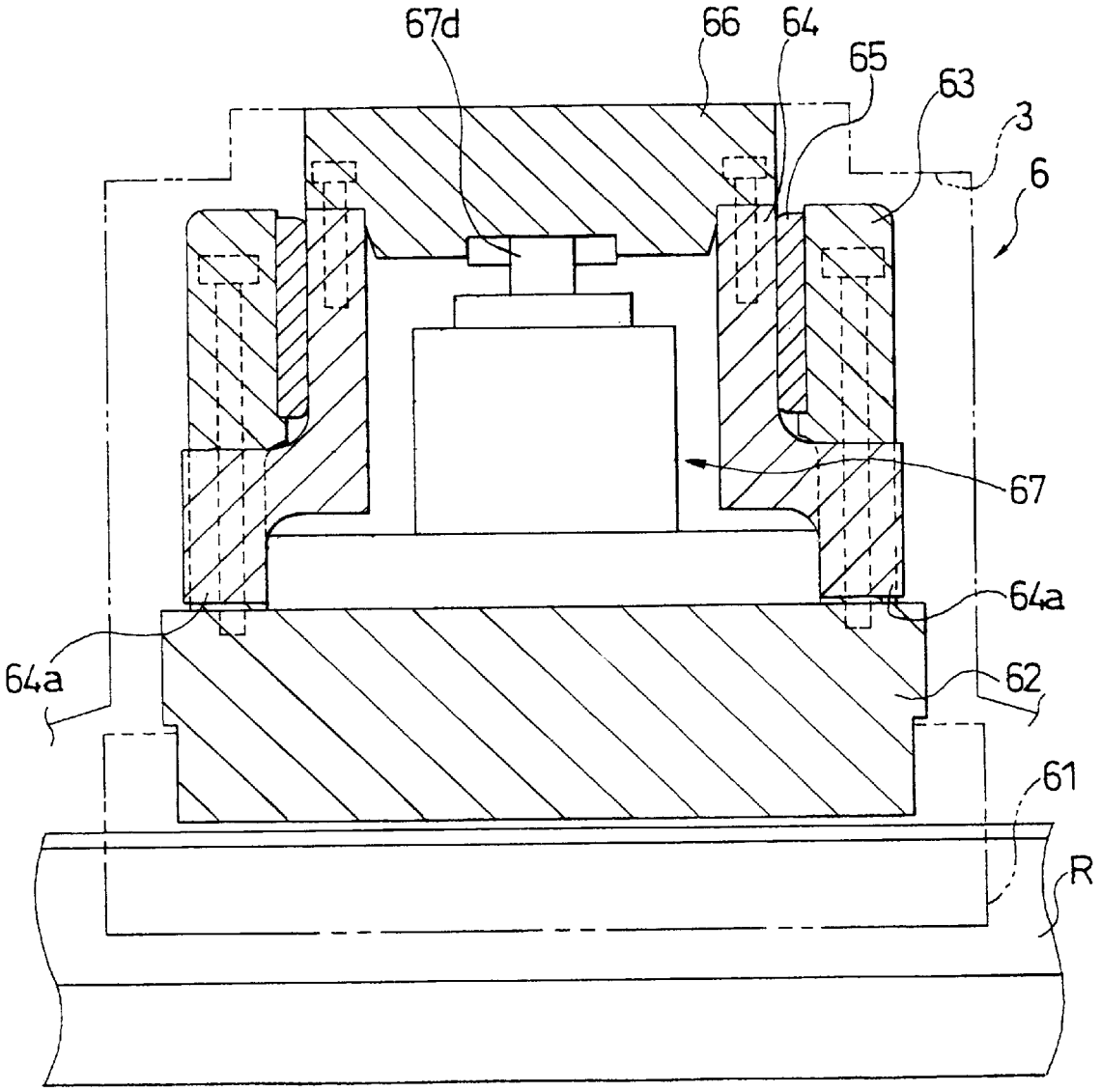
FIG. 3 is an X—X cross-sectional view of FIG. 1, mainly showing an internal structure of a floater unit.
Figure 4:
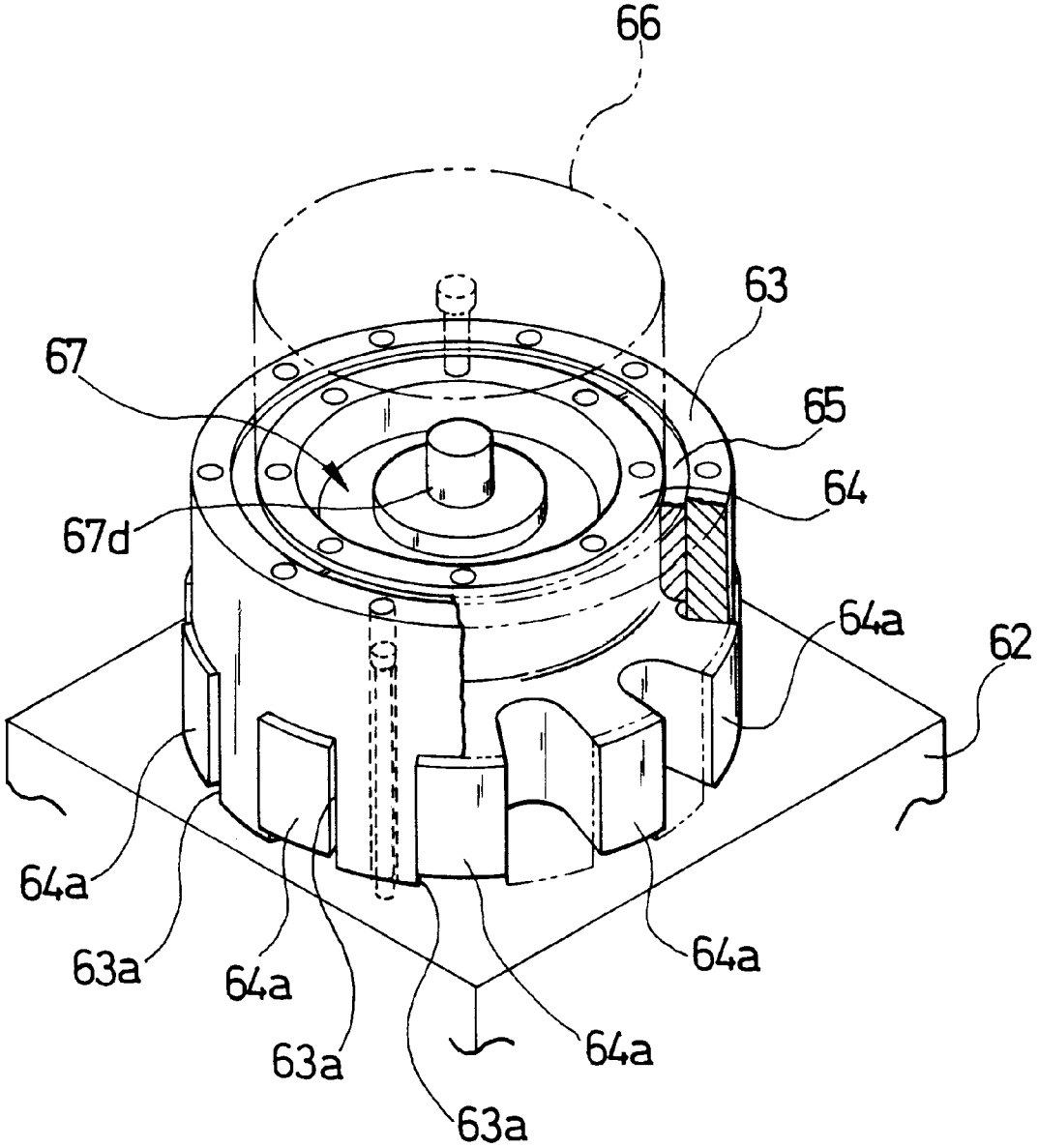
FIG. 4 is a partially cutaway view showing the appearance of the floater unit according to the present invention.

FIG. 3 is an X—X cross-sectional view of FIG. 1, mainly showing an internal structure of a floater unit, and FIG. 4 is a partially cutaway view showing the appearance of the floater unit according to the present invention. By referring to these figures, the floater units will now be described in detail. Since each floater unit has substantially the same construction, the description will be made to the floater unit 6 depicted on FIGS. 3 and 4, and the description of other floater units 6 will be omitted.

A support 62 for a gas spring is equipped with an upper portion of the rail communication portion 66, and onto the upper surface of the gas spring support 62, a gas spring 67 is fixed. A piston which contracts or detracts depending upon the pressure of the injected gas is placed onto the upper portion of the gas spring 67, and lifts a lower connection portion 66.

The upper surface of the connection portion 66 is fixed onto the lower mold 3. On the lower circumference 64 of the connection portion 66, circular sliding wall 64 is formed to surround the gas spring 67. The sliding wall 64 is in contact with a guide wall 63 in a slidable manner via a color 65. The guide wall 63 is also formed into a circular shape to surround the gas spring 67, and is fastened to the support 62 for gas spring by a bolt.

Stopper holes 63*a*, 63, . . . are formed on lower portions of the guide wall 63, and project portions 64*a*, 64*a*, . . . , which project radially, are formed on lower portions of the sliding wall 64. Each of the project portions 64 are bored through the corresponding stopper hole 63*a*. Specifically, by regulating the vertical movement and the movement in the circumference of the project portion 64*a*, the vertical movements of the sliding wall 64 and the lower mold 3 are regulated. In this embodiment which utilized the floater unit 6, the distance of possible vertical movement of the projection portion 6*a* is approximately 2 mm.

The gas spring utilized in this embodiment is a gas charge type spring.

The lower mold 3 according to this embodiment floated about 2 mm by the floater units 6, 6 . . . in the situation and is supported on the guide rails R, R, and R.

The construction that the lower mold 3 is always supported by the floater units 6, 6, . . . exhibits the following advantageous effects in comparison with the construction of the general prior art: There is no need for lifting the lower mold 3 by means of a die lifter for every horizontal movement, thus reducing the cycle time at the time of carrying out the hemming process to thereby enhance the workability.

In this embodiment, the mechanism for floating the lower mold is made up of the floater units 6 utilizing the gas charge type spring, but the mechanism for floating the lower mold of the present invention is not restricted thereto. For example, a spring mechanism (hereinafter referred to as "air cushion type mechanism") may be considered which holds the floating state of the lower mold 3 by means of the injection of a gas.

Figure 5:
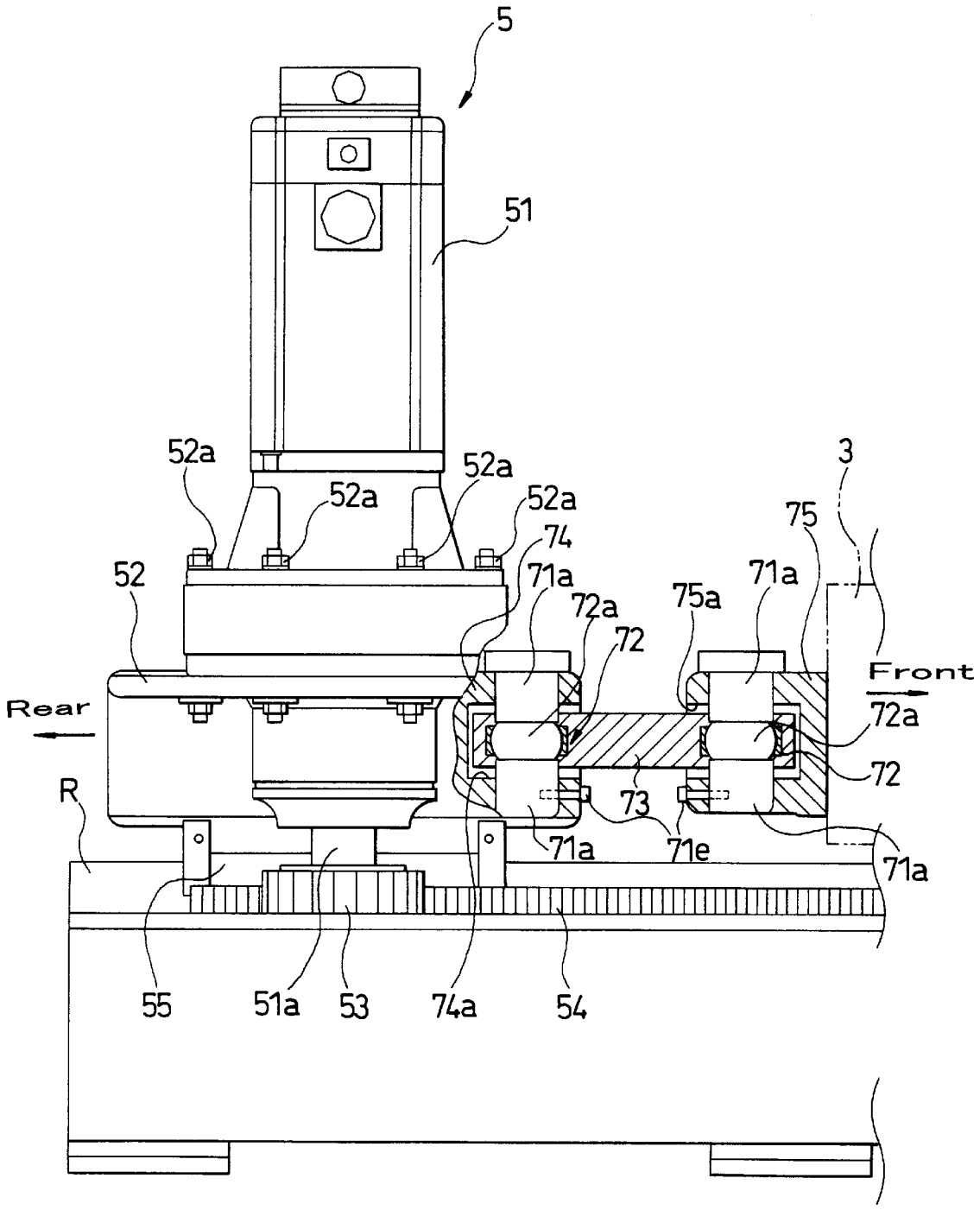
FIG. 5 is a Y—Y cross-sectional view of FIG. 1, showing an internal structure of a gas spring.

The lower mold 3 supported by the floater units 6, 6, . . . is connected to the mechanism 5 for moving the lower mold via a connection mechanism 7. As described previously, the lower mold 3 is secured to keep the floating state by the function of the floater units 6, 6, . . . . Relative to the lower mold 3 which is in the floating state, the upper mold 2 descends to apply a pressure. When the upper mold 2 ascends to release the application of the pressure, the lower mold 3 is pitched. When the pitch is transmitted to the mechanism 5 for moving the lower mold, the operation of the mechanism 5 for moving the lower mold is sometimes out of order. For this reason, in the hemming apparatus 1 according to this embodiment, the connection mechanism 7 for absorbing the pitch of the lower mold 3 is placed. FIG. 5 is a perspective view of the line Y—Y of FIG. 1, and shows a part of the connection mechanism 7 in a broken section. By referring to FIG. 5, the connection mechanism 5 and the mechanism for moving the lower mold will now be described in greater detail.

At the rear portion of the lower mold 3 and the front portion of the mechanism 5 for moving the lower mold, opposite connection brackets 74 and 75 project, respectively. Onto these connection brackets 74 and 75, holes 74*a* and 75*a* for holding the connection bar are formed, into which ends of a connection bar 73 is inserted. At the front end and the rear end of the connection bar 73, spherical bearings 72 and 73 are provided. Onto spherical contact portions of spherical bearings 72 or 73, a strut 71*a* is fixed, respectively, and they are born by the connection brackets 74 and 75, respectively. To be specific, the connection mechanism 7 according to this embodiment is composed of the connection bar 73 and the strut 71*a* which are connected via the spherical bearing 72, and the connection brackets 74 and 75 for bearing the strut 71*a*.

The present invention is not restricted to the connection mechanism 7 according to this embodiment. Specifically, the connection mechanism 7 may be any mechanism as long as it is composed of a drive transmission for transmitting the horizontal drive and an absorbing portion for absorbing the pitch. In this embodiment, the connection bar 73 and the strut 71*a*, which are connected via the spherical bearing 72 correspond to the drive transmission for transmitting the horizontal drive and the spherical bearing 72 corresponds to the absorbing portion for absorbing the pitch.

In the case where the construction of the mechanism 5 for moving the lower mold is of well resistance to the pitch or has little influence upon the pitch, the connection mechanism 7 is not necessarily required. In such a case, the mechanism 5 for moving the lower mold may be directly connected to the lower mold 3.

The mechanism 5 for moving the lower mold onto which the connection bracket 74 is fixed will now be described.

The connection bracket 74 is fixed onto a support 52 for the motor. A drive motor 51 is fixed onto the support 52 for the motor by means of bolts 52*a*, 52*a*, . . . The output shaft of the drive motor 51 projects downward penetrating through the support 52 for the motor. The tip of the output shaft 51*a* is provided with a pinion 53. When the pinion 53 revolves by being engaged with a rack 54, the mechanism 5 for moving the lower mold 3 moves in the lengthwise direction of the rack 54. This movement is transmitted to the connection mechanism 7 as a driving force and further to the lower mold 3 via the mechanism 5 for moving the lower mold.

Consequently, due to the regulation of driving the drive motor 51, the horizontal movement of the lower mold 3 is regulated.

In the mechanism 5 for moving the lower mold according to this embodiment, a pinion-rack mechanism is utilized. Accordingly, if the vertical movement of the lower mold 3 during the course of the hemming processing is transmitted to the pinion-rack mechanism, the positional relationship of the engagement between the pinion 53 and the rack 54 (see FIG. 5) cannot be maintained, causing a failure and the like. Specifically, in the mechanism 5 for moving the lower mold according to this embodiment, the transmission of the pitch is prevented by the placement of the connection mechanism 7.

Due to the operation of the mechanism 5 for moving the lower mold, the lower mold 3 moves between the position for setting the panel and the position to be hemmed. The position to be hemmed is a position facing the upper surface of the lower mold 2 to the upper mold 3 at which the upper mold 2 descends to hem the marriage panel W. As shown in FIG. 1, four mechanisms 4, 4, . . . for pressing the upper mold are placed surrounding the upper mold 2. The upper mold 2 is supported by these mechanisms 4, 4, . . . for pressing the upper mold, and moves by the actuation of these mechanisms 4, 4, . . . for pressing the upper mold. Specifically, the controlled drive of the mechanisms 4, 4, . . . for pressing the upper mold, the pressure force of the upper mold 2 is controlled accordingly.

Next, the mechanism 4 for pressing the upper mold will now be described briefly by referring to FIG. 2.

The mechanism 4 for pressing the upper mold possesses a main shaft 46 which revolves as the shaft, and a drive motor 49 which drives the main shaft 46. The main shaft 46 stands vertically, and a connection portion serving as a moving element is screwed on the upside of the main shaft. The connection portion 45 is fixed onto the upper mold 2. On the other hand, the lower portion of the main shaft 46 is supported by a bearing 46 for the main shaft in a rotatable manner, and the bearing 46 for the main shaft and the drive motor 49 are fixed onto the base B. A gear mechanism 48 is intervened between the main shaft 46 and the drive motor 49. Consequently, the rotation force of the drive motor is reduced by the gear mechanism 48, and then is transmitted to the main shaft 46.

The use of the hemming apparatus described previously makes it possible to carry out the hemming process according to the present invention. The hemming process according to the present invention will now be described specifically step by step. In addition, the functions of the hemming apparatus 1 in each stage will be described by referring to the drawings. FIG. 6 is an explanatory plane view which illustrates the function of the hemming apparatus according to the present invention, mainly showing the horizontal movement of the lower mold, and FIG. 7 is an explanatory plane view which illustrates the function of the hemming apparatus according to the present invention, mainly showing the vertical movement of the upper mold.

Figure 6A:
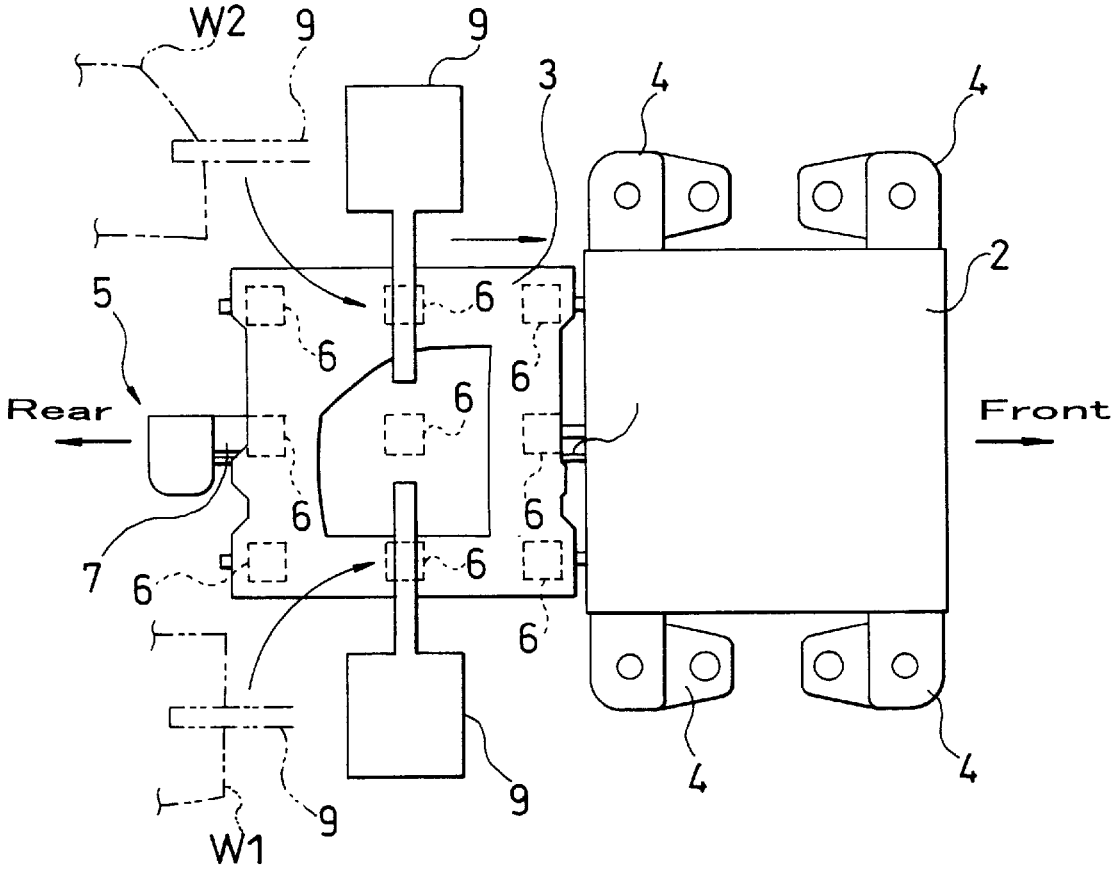
FIGS. 6A and 6B are explanatory views which illustrate the function of the hemming apparatus according to the present invention, mainly showing the horizontal movement of the lower mold.

As shown in FIG. 6A, a marriage panel W is set on the lower mold 3 in the first step. In this embodiment, the outer panel W1 is transported by one robot 9 and the inner panel W2 is transported by another robot 9. Subsequently, at the time of placing the panels onto the lower panel 3, the panel W1 and the panel W2 have been previously put together with each other to form the marriage panel W. However, the setting of the marriage panel is not restricted thereto. For example, it is within the scope of the present invention that the marriage panel W has been previously formed, and the formed marriage panel W is transported by the robot 9 to set the marriage panel W on the lower mold 3.

The lower mold 3 stands by at the position for setting the panel in order to carry out the first stage of the hemming process. After setting the marriage panel W, the mechanism 5 for moving the lower panel is driven to shift the first stage to the second stage.

Figure 6B:
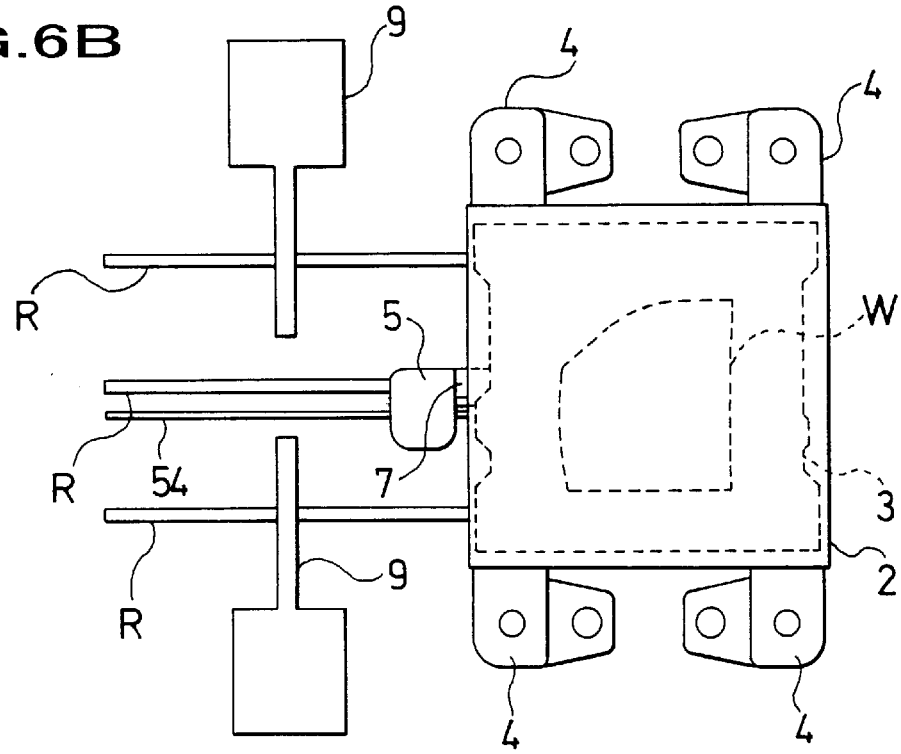

In the second stage of the hemming process according to the present invention, the lower mold 3 is caused to move to the position to be hemmed. When the mechanism 5 for moving the lower mold is driven, the pinion 53 which is engaged with the rack 54 revolves (see FIG. 5). Meanwhile, the lower mold 3 is guided by the guide rails R, R, . . . to move forward (see the arrow depicted on FIG. 6A). When the lower mold 3 moves to the position to be hemmed, i.e., the position the upper surface of the lower mold 3 faces to the upper mold 2, the mechanism 5 for moving the lower mold is stopped. Thereafter, the stage is shifted to the third stage. FIG. 6B shows the situation where the lower mold 3 reaches to the position to be hemmed.

Figure 7A:
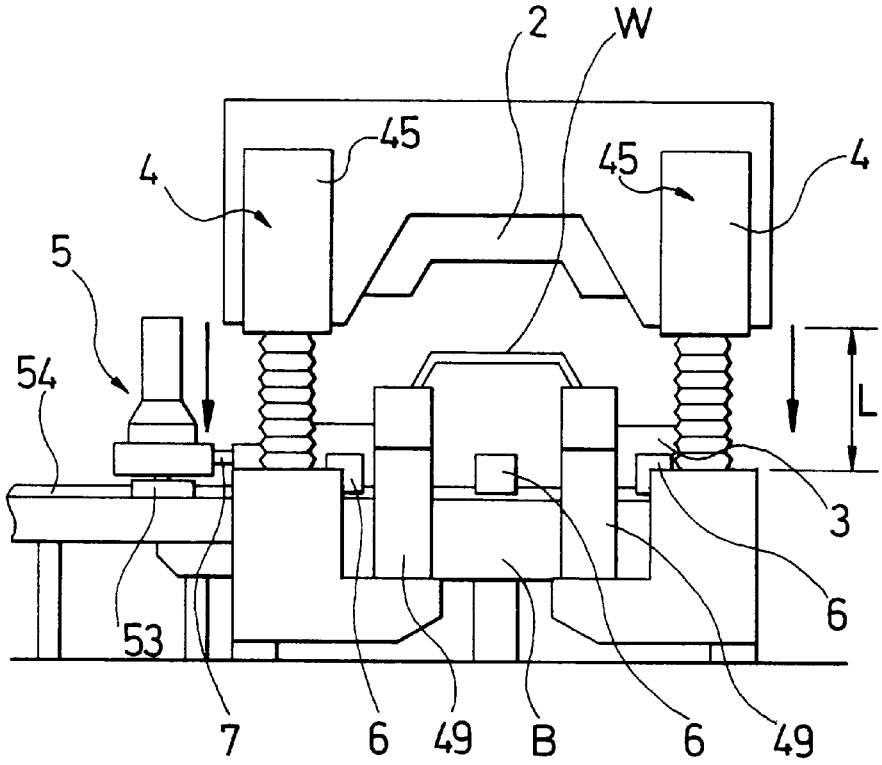
FIGS. 7A and 7B are explanatory views which illustrate the function of the hemming apparatus according to the present invention, mainly showing the vertical movement of the upper mold.
Figure 7B:
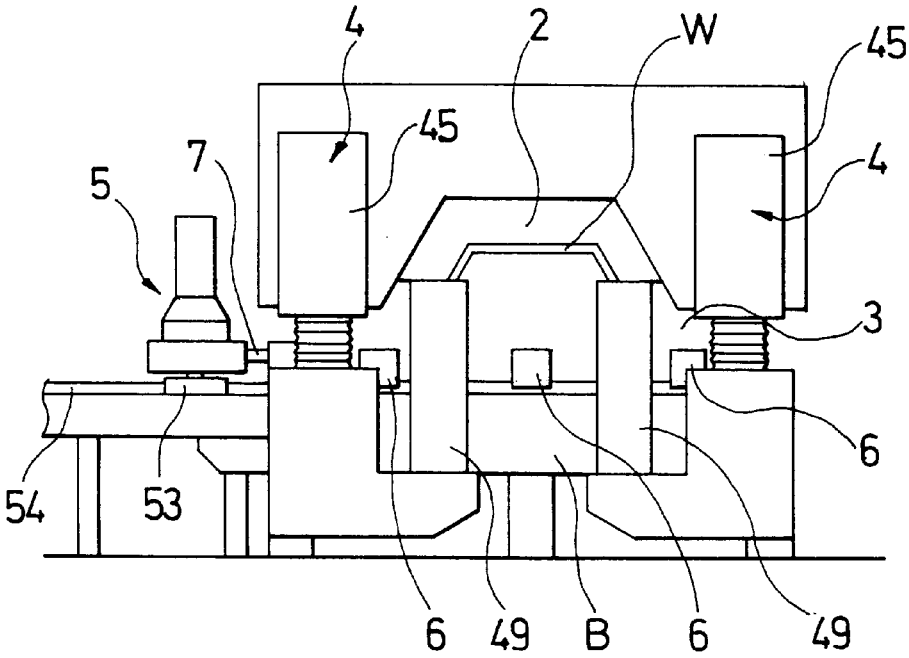
Figure 8A:
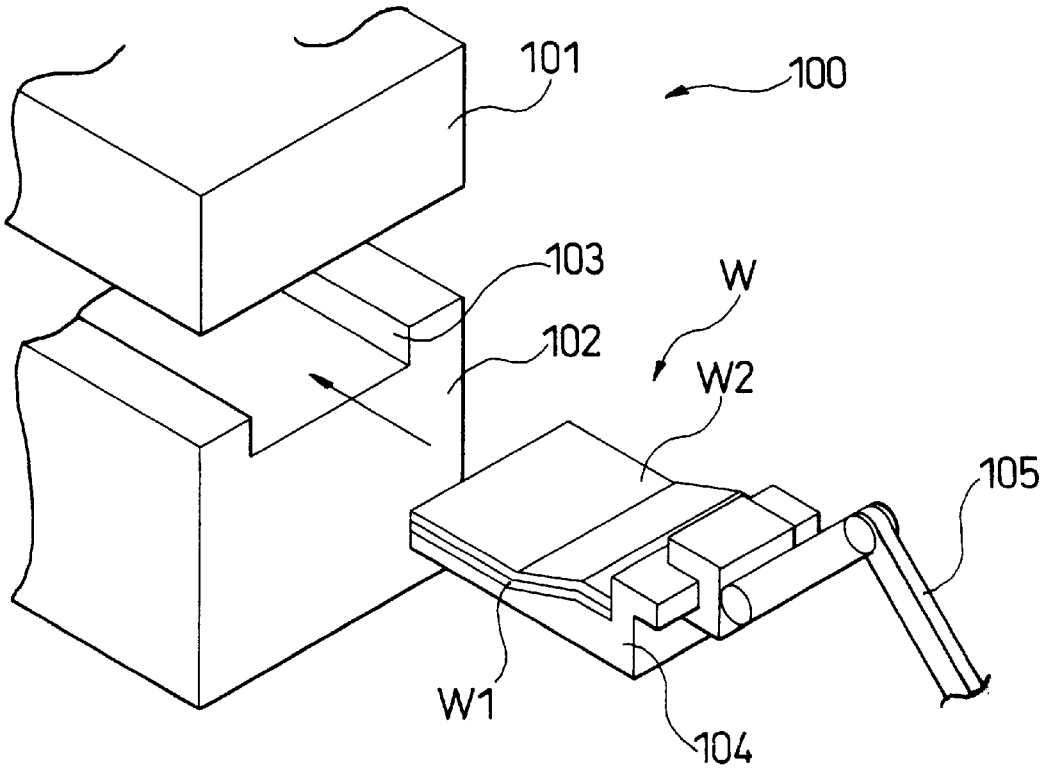
Prior Art FIG.8A
FIGS. 8A and 8B are explanatory views showing the conventional hemming apparatus, where
Figure 8B:
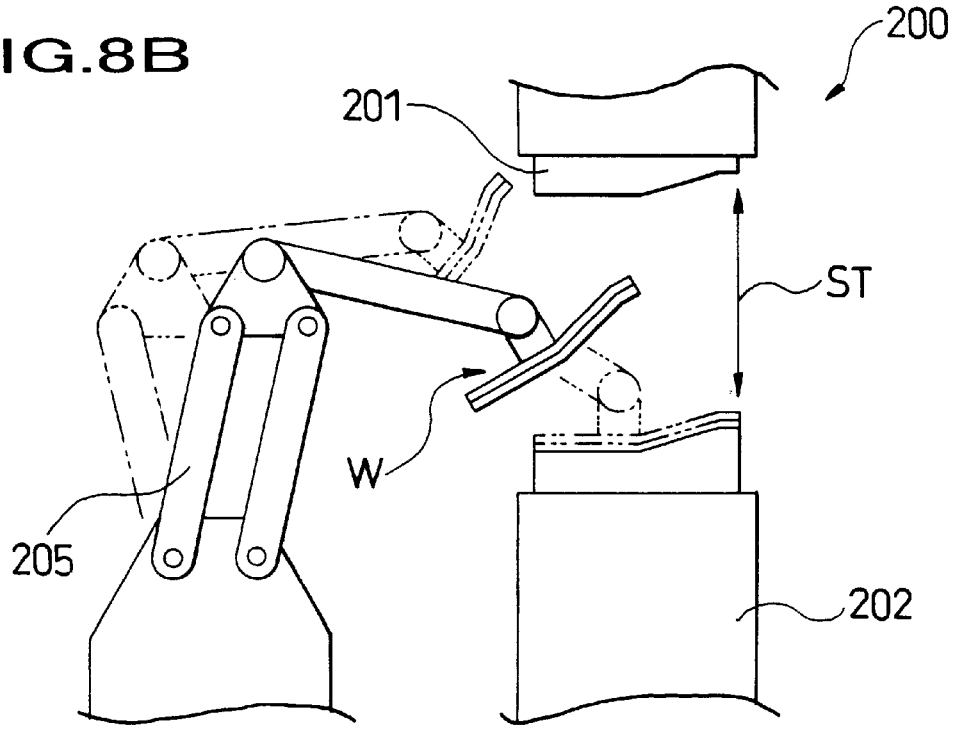

In the third stage, the upper mold 2 descends toward the lower mold 3 as shown in FIG. 7A to clamp the marriage panel W by both molds 2 and 3. Specifically, the marriage panel W is compressed by the upper mold 2 to hem the marriage panel W.

In the third stage, the drive motor 49 for the mechanisms 4 for pressing the upper mold is positively driven to cause the main shaft 46 at a prescribed amount in the positive direction. The term "positive direction" used herein is intended to mean the direction where according to the rotation of the main shaft 46 (see FIG. 2), the connection portion 45 descends. The term "prescribed amount" used herein is intended to be an amount such that the upper mold 2 descends to hem the marriage panel W.

When the hemming process has been completed, the stage is shifted to a post stage. Specifically, the drive motor 49 is negatively driven. In this case, the main shaft 46 (see FIG. 4) rotates to the negative direction, i.e., the direction opposite the positive direction as a prescribed amount. According to the negative rotation, the connection portion 45 ascends to release the compression to the marriage panel W. The term "prescribed amount" in this case means a distance L that the connection portion 45 does not come off from the main shaft 46 (see FIG. 2) and the lower mold 3 can be vertically moved. When the upper mold 2 moves in a prescribed amount, the mechanism 5 for moving the lower mold is driven to horizontally move the lower mold 3 to the position for setting the panel. Thereafter, the marriage panel W, which has been hemmed is held by the robot 9 (see FIG. 6) to be shifted to the next stage.

While the hemming process utilizing the hemming apparatus 1 has been described, but the hemming apparatus according to the present invention is not restricted to the specific embodiments described above. Also, the hemming process according to the present invention is not restricted the specific embodiment utilizing the hemming apparatus 1 described above.

In comparison with the prior art hemming apparatus, the hemming apparatus according to the present invention can reduce the stroke length of the vertical movement of the upper mold, enhancing the workability.

When the hemming apparatus according to the present invention has a mechanism for floating the lower mold, since it is not necessary to lift the lower mold for every movement of the lower shift by means of a die lifter or such, the time required for moving the lower mold can be reduced.

What is claimed is:

1. A hemming process which includes arranging one panel together with another panel to form a marriage panel, and unifying the panels with each other by clamping the marriage panel between an upper mold and a lower mold, said process including:

a first step of setting the marriage panel onto the lower mold by a transporting unit;

a second step of horizontally moving the lower mold, on which the marriage panel has been set, to the position to be hemmed facing the upper mold by, means of a mechanism for moving the lower mold; and a third step of vertically moving the upper mold to the position corresponding to the lower mold to thereby hem the marriage panel.

2. The hemming process as claimed in claim 1, wherein said upper mold is vertically moved while a floating mechanism employing at least one gas spring supports said lower mold in a floating state.

3. A hemming apparatus for vertically moving an upper mold toward a lower mold to thereby hem a marriage panel, comprising:

a mechanism for moving the lower mold in a horizontal direction so as to be movable between a hemming position that faces the upper mold and a setting position where the marriage panel is set on the lower mold.

4. The hemming apparatus as claimed in claim 3, wherein said upper mold is vertically moved while a floating mechanism supports said lower mold in a floating state.

5. The hemming apparatus as claimed in claim 4, wherein said floating mechanism employs at least one gas spring.

6. The hemming apparatus as claimed in claim 3, wherein said mechanism for moving the lower mold comprises a motor, and said lower mold is horizontally moved by the motor.

7. The hemming apparatus as claimed in claim 6, wherein said mechanism for moving the lower mold is directly connected to the lower mold.

8. The hemming apparatus as claimed in claim 4, wherein said mechanism for moving the lower mold comprises a motor, and said lower mold is horizontally moved by the motor.

9. The hemming apparatus as claimed in claim 8, wherein said mechanism for moving the lower mold is directly connected to the lower mold.

10. The hemming apparatus as claimed in claim 5, wherein said mechanism for moving the lower mold comprises a motor, and said lower mold is horizontally moved by the motor.

11. The hemming apparatus as claimed in claim 10, wherein said mechanism for moving the lower mold is directly connected to the lower mold.

12. The hemming apparatus as claimed in claim 7, further comprising a connection mechanism for absorbing a pitch of the lower mold.

* * * * *